US010316529B2

(12) United States Patent
Chambers et al.

(10) Patent No.: US 10,316,529 B2
(45) Date of Patent: Jun. 11, 2019

(54) MOTORIZED FLOOR STRIPPER MACHINE

(71) Applicant: Crain Cutter Company, Inc., Milpitas, CA (US)

(72) Inventors: Gregory Joseph Chambers, Morgan Hill, CA (US); Tan Dinh Nguyen, Milpitas, CA (US); Lance Darrell Crain, Pleasanton, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 234 days.

(21) Appl. No.: 14/788,036

(22) Filed: Jun. 30, 2015

(65) Prior Publication Data

US 2017/0002576 A1 Jan. 5, 2017

(51) Int. Cl.
*E04G 23/00* (2006.01)

(52) U.S. Cl.
CPC ..... *E04G 23/006* (2013.01)

(58) Field of Classification Search
CPC ..... E04G 23/006
USPC ..... 299/37.1, 37.2, 38.1
See application file for complete search history.

(56) References Cited

U.S. PATENT DOCUMENTS 2,774,586 A 12/1956 Becker
2,874,946 A 2/1959 Singleterry et al.
2,906,514 A 9/1959 Becker
3,251,629 A 5/1966 Crawley
3,376,071 A 4/1968 Stein
4,162,809 A 7/1979 Anderson et al.
4,512,611 A * 4/1985 Grasse ..... A47L 11/12 15/93.1
4,598,476 A * 7/1986 Grasse ..... A47L 13/08 30/169
4,626,033 A 12/1986 Anderson
4,686,797 A * 8/1987 Hoffman ..... B24B 23/043 15/22.1
4,821,357 A 4/1989 Millette
4,963,224 A 10/1990 Anderson
5,702,161 A * 12/1997 Finney ..... B29C 63/0013 15/93.1
6,135,566 A 10/2000 Anderson
6,343,981 B1 * 2/2002 Buchanan ..... E04G 23/006 156/763
7,082,686 B2 8/2006 Anderson
7,152,930 B2 12/2006 Jertson
7,712,839 B1 5/2010 Chen

* cited by examiner

*Primary Examiner* — David J Bagnell
*Assistant Examiner* — Michael A Goodwin
(74) *Attorney, Agent, or Firm* — Fenwick & West LLP

(57) ABSTRACT

A motorized floor stripper machine includes a motor, a frame, and a blade carrier. The blade carrier is capable of holding blades of different sizes, which can be installed on the blade carrier. The blade carrier is mounted to the frame on shock absorbers. A cam on the frame is connected to the blade carrier by a linkage that includes a bearing block, a pivot plate, a pivot pin, and a support plate. The blade carrier includes ball bearings that fit within linear channels mounted to the frame, so that when the cam is driven in an orbital motion, the blade carrier moves in a generally linear forward-backward motion. The blade carrier is relieved and includes multiple sets of holes for securing blades of different sizes.

9 Claims, 5 Drawing Sheets

MOTORIZED FLOOR STRIPPER MACHINE

BACKGROUND

This invention relates generally to flooring tools, and in particular to motorized floor stripper machines.

Floor stripper machines are used to strip flooring materials that are glued down to concrete or wood subfloors. FIG. 1 shows a prior art stripper machine 10 that is made with a frame 12, a blade carrier 14, a blade 16, and an electric motor 18. FIG. 2 is a partial bottom view of stripper machine 10, showing how rotational energy generated by the motor spindle 19 is translated into an orbital motion by attaching a cam 20 (eccentric) to the spindle 19. Cam 20 is inserted into a plate 22 that forms a linkage between the cam 20 and a blade carrier 14. Thus the orbital motion of the cam 20 is transferred by the plate 22 to a blade carrier 14, which moves the blade 16 in an orbital motion which is useful for stripping the flooring from the subfloor. As shown in FIG. 1, blade 16 is clamped down on to the blade carrier 14 (at bottom) by blade clamp 26 (on top) by fasteners 28. The prior art blade carrier and blade clamp are both rectangular in shape and about as wide as a prior art blade. In operation, the user pushes the machine at the handles 24, and the orbital motion of the blade 16 assists in stripping the flooring off the subfloor.

Different forms of linkage between the cam and the blade carrier can be used to produce different forms of motion in the blade. In some early stripper machines, the linkage is formed by the cam element simply contacting the blade carrier from behind and pushing the blade carrier in a forward direction. In later machines, the cam is inserted in a plate to form a linkage, and the plate is connected to the blade carrier by way of fasteners. When only a single plate is used to form the linkage to the blade carrier, the orbital motion of the cam is transferred directly to the blade carrier. As a result, the blade carrier and blade move in an orbital motion with both left-to-right and forward and backward components. However, it is mainly the forward component that is useful in stripping the flooring. The left to right motion causes extra vibration, and can combine with the centrifugal force of the motor itself to cause the machine to turn towards the user's right. In such case, the user has to counteract the turning by steering the machine against it, which requires extra effort. For this reason, alternative forms of linkage have been developed to minimize the undesirable left to right motion, and others have been developed to produce only forward and backward motion in the blade carrier.

In many of the existing motorized floor stripper machines, the linkages between the cam element and the blade carrier element have durability problems, while others produce undesirable left to right motion in the blade carrier which must be controlled. For example, pushing linkages present durability problems. The constant rubbing of the cam against a back side surface of a blade carrier wears out these parts, and the springs necessary to hold the blade carrier in contact with the cam also wear out quickly. It may be preferable to insert the cam within a plate to form the linkage, and then use the plate to impart the motion of the blade carrier. However, inserting the cam into such a plate produces the undesirable left to right motion when the plate is connected to the blade carrier. Some prior art motorized floor stripper machines use a linkage in which the cam is connected to a first drive plate, and the first drive plate is connected to a second drive plate fixedly connected to the blade carrier by way of an additional pivot. In conjunction with the additional pivot, these machines include costly slide bearings to eliminate any undesirable left to right motion in the blade carrier.

To limit the left to right portion of the motion produced by the cam, as just mentioned, some prior art motorized floor stripper machines have included slide bearings with a long arm or rod that moves forward and backward within a sleeve. Other prior art motorized floor stripper machines reciprocate an arm portion of their blade carrier element within a channel of a housing. Still others use a control arm connected to one side of the frame that forms a forward pivot to limit the left to right motion. However, devices employing slide bearings, reciprocating arms, or a control arm are easily damaged if the machine is dropped on its blade carrier element. The problem of dropping of the machine on its blade carrier can often occur on a jobsite. The machines are normally transported around a job by rocking them back on their rear wheels and pushing them. If the user is not careful to lower the machine gently back down onto the blade carrier, then bending of slide bearings, blade carrier arms, or control arms can result. If these elements become bent, they will no longer function properly and can be very expensive to repair.

To prevent the blade carrier or connected components from being damaged if the front of the stripper machine is dropped, it would be desirable to have some sort of shock absorber between the frame of the machine and the blade carrier that could absorb some of the impact. Some existing motorized floor stripper machines use elastomeric shock absorbers, but a problem with these shock absorbers is that they sometimes do not provide sufficient resistance for efficient stripping of tough or hard materials. For example, in the stripping of hardwood or ceramic tile floors, the resistance encountered by the blade and transferred back to the shock absorbers by the blade carrier may be greater than the shock absorbers can counteract. As a result, despite the continuing motion of the cam, the blade carrier recoils against the shock absorbers, which give and allow the blade carrier to move backwards. In this situation, the forward motion of the blade is effectively stopped. Therefore, if the machine is to employ shock absorbers between the frame and the blade carrier, it would be desirable to additionally provide a means to guide the motion of the blade carrier so that it can move only with the motion of the cam. This would improve the effectiveness of the stripping motion of the machine.

The blade carrier of prior art stripper machines have typically been made in two parts: a bottom blade carrier and a top blade clamp. The top blade clamp is fastened down on top of the blade using screws that thread into the bottom blade carrier. A problem with many of these devices is that they use a blade carrier that has a rectangular shape and is quite wide, about as wide as the blade itself. However, if a substantially narrower blade is installed on such a wide blade carrier, the blade carrier itself may contact areas of the floor that have not yet been stripped by the narrower blade. This can create significant unnecessary resistance.

As an example, as shown in FIG. 1, it would be desirable to mount narrower blades onto blade carrier 14 for removal of tougher or harder materials, such as wood or ceramic tile. This is because the machine is only powerful enough to strip up only a narrow row of the material. However, when only a narrow row is stripped, a rectangular blade carrier that is wider than the blade can impact the unstripped material on either side of the row, creating unnecessary resistance. Moreover, the blade carrier can be held up at an elevation as it contacts the top surface of unstripped material on either side of the row, which can prevent the blade from getting beneath the material being stripped.

An additional problem with existing blade carriers that have only two wide set blade clamp holes for clamping a single type of wide blade is that they do not function well with narrower blades. If the blade clamp fasteners are not positioned at least close in proximity to the width of the blade (more ideally through holes or slots provided in the actual blade), the blade can slip backward when it contacts tough or hard materials. Furthermore, if the upper blade clamp is not clamped down very tightly at least in the area of the blade, the upper blade clamp can get debris built-up beneath it that can form a wedge and cause damage.

For these reasons, it would be desirable for the blade carrier and blade clamp to include a number of mounting positions for a number of blades of various widths, particularly blades having substantially narrower widths than prior art blades. Furthermore, it would be desirable for the outer edge of the blade clamp and blade carrier to include a shape that would allow the blade carrier and blade clamp to follow behind a substantially narrower blade without contacting areas of the floor which are not yet stripped, such as either side of a previously stripped row of hardwood or ceramic tile flooring.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 2:
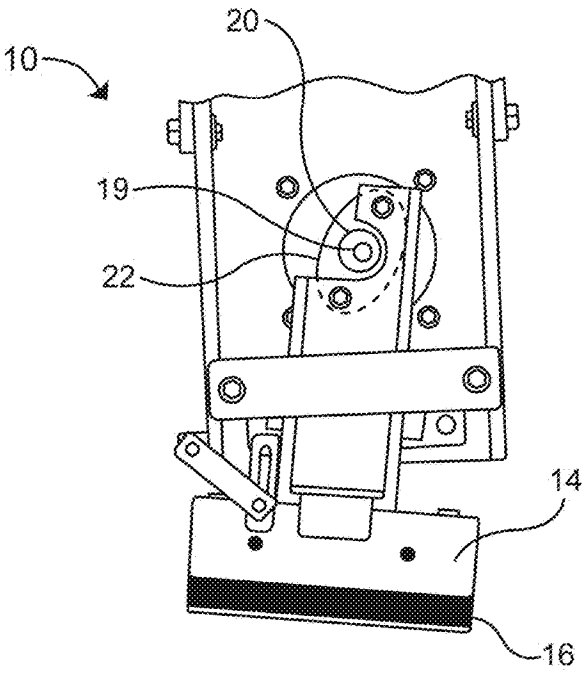
Figure 2 Prior Art
FIG. 2 is a partial bottom view of the prior art stripper machine of FIG. 1.
Figure 1:
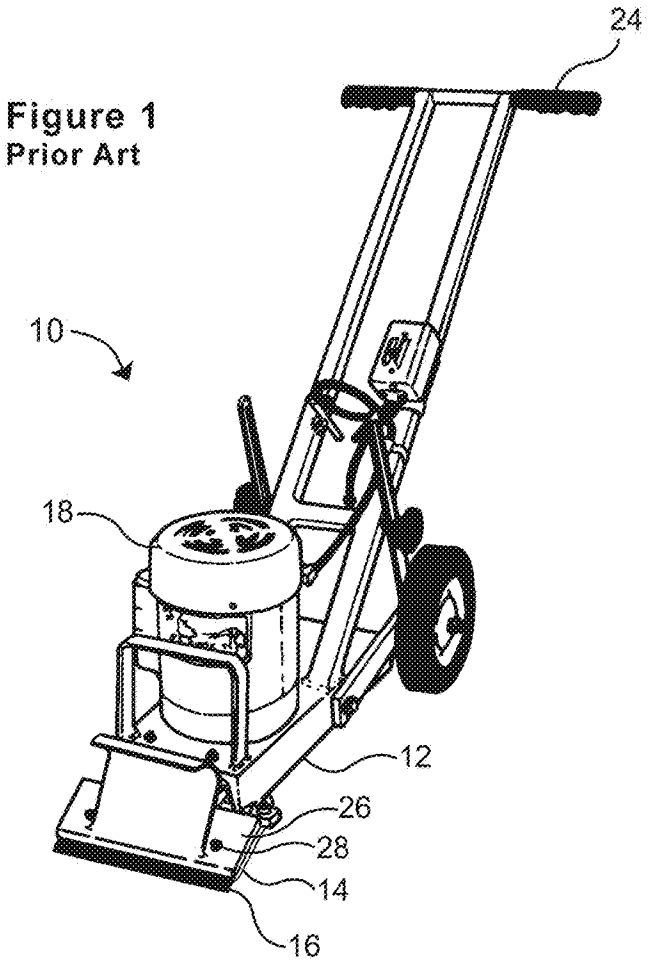
Figure 1 Prior Art
FIG. 1 shows a prior art stripper machine.
Figure 3:
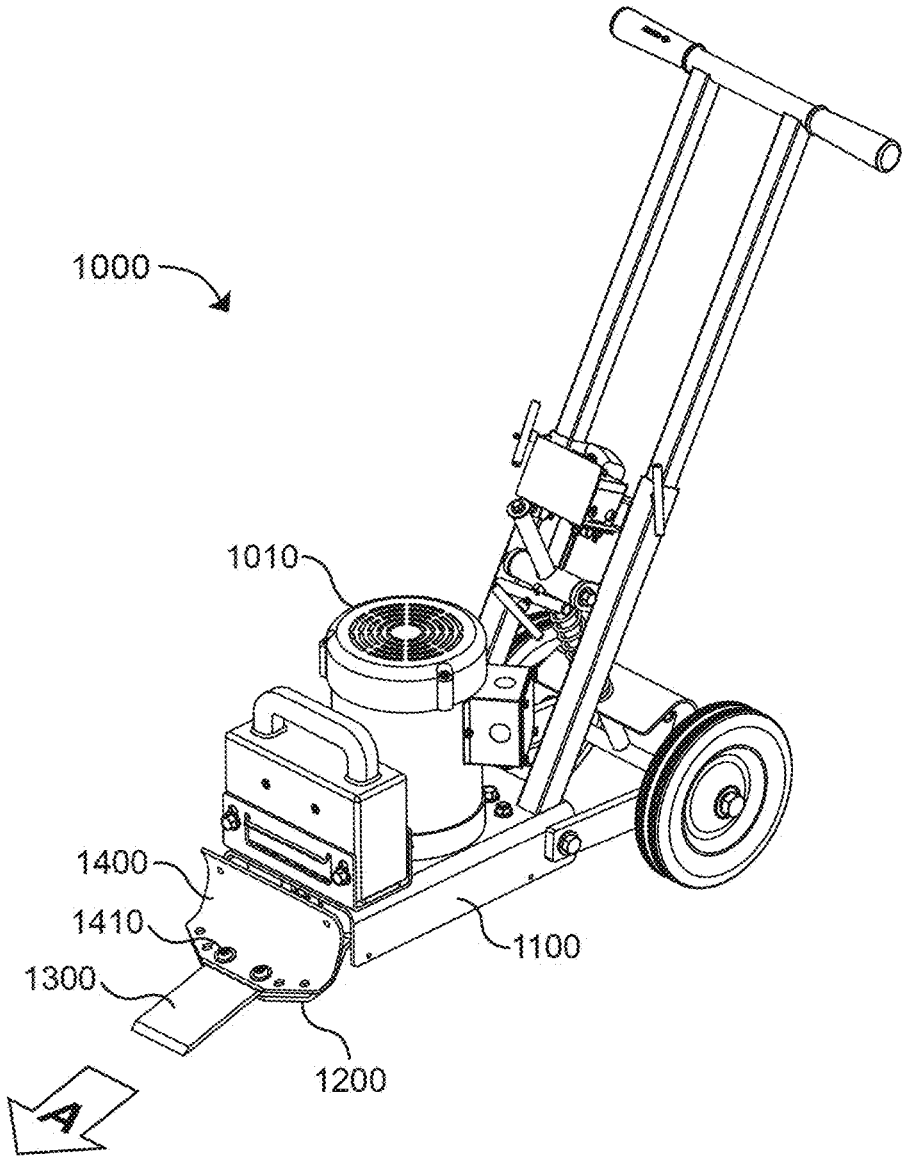
FIG. 3 shows a motorized floor stripper machine in accordance with an embodiment of the invention.

As shown in FIG. 3, stripper machine 1000 includes a motor 1010, a frame 1100, and a blade carrier 1200. Blade carrier 1200 is capable of holding blades of different sizes, and FIG. 3 shows a blade 1300 that is narrower than most conventional blades is installed on blade carrier 1200. Blade 1300 is installed on blade carrier 1200 using blade clamp 1400 and blade clamp screws 1410.

Figure 4:
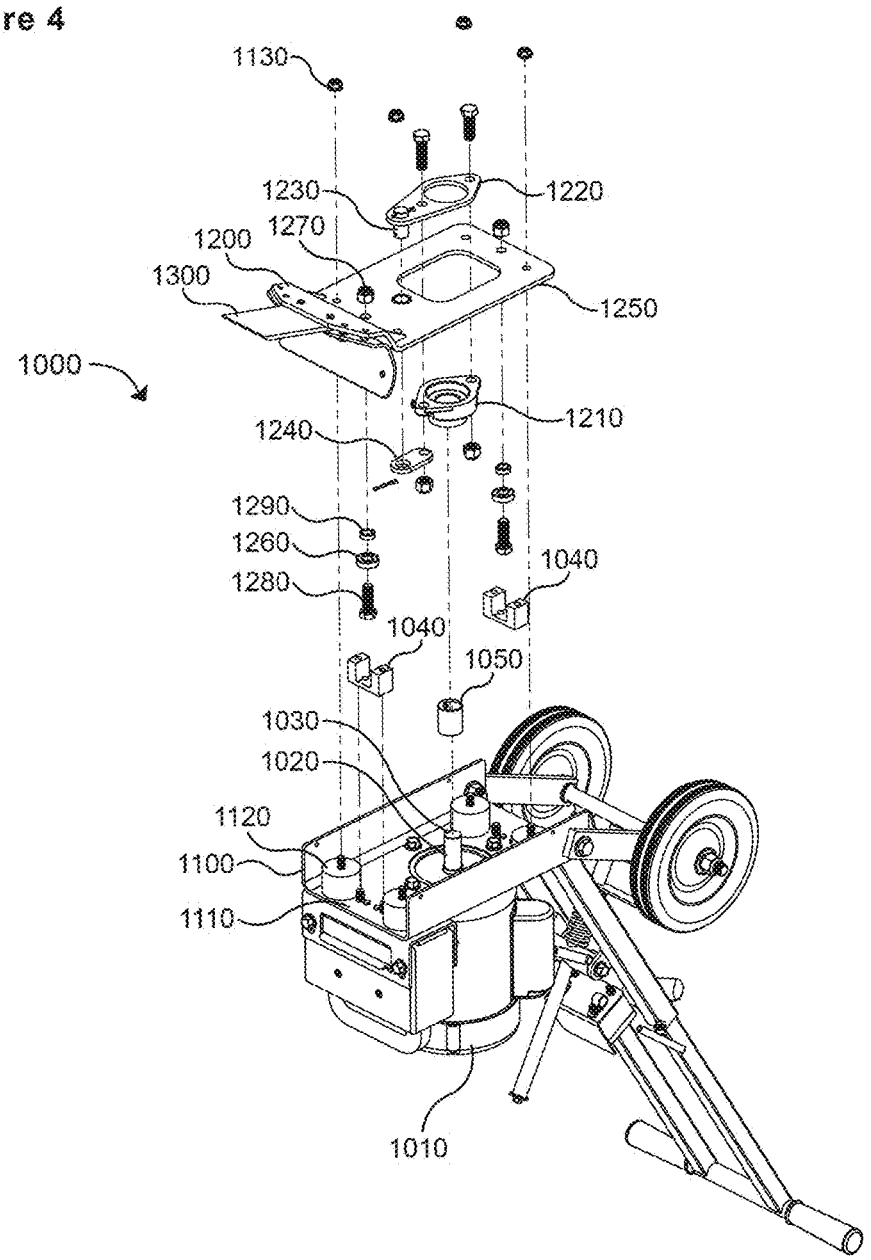
FIG. 4 is a partially exploded bottom view of the motorized floor stripper machine of FIG. 3, in accordance with an embodiment of the invention.

As shown in FIG. 4, blade carrier 1200 is mounted to frame 1100 at frame bottom surface 1110 on four shock absorbers 1120. Shock absorbers 1120 are made with a rubber core, and each has a threaded fastener vulcanized to the top and bottom faces of their core. Blade carrier 1200 is fastened down on four shock absorbers 1120 by four nuts 1130. Also fastened to frame bottom surface 1110 are two channels 1040 and motor 1010. Motor 1010 has a spindle 1020 and a key 1030. Key 1030 inserts into cam 1050 and turns cam 1050.

Cam 1050 is connected to blade carrier 1200 by a linkage including bearing block 1210, pivot plate 1220, pivot pin 1230, and support plate 1240. When cam 1050 is turned by key 1030, pivot plate 1220 develops an orbital motion. In turn, blade carrier 1200 would also be moved in a corresponding orbital motion by pivot pin 1230.

Figure 5:
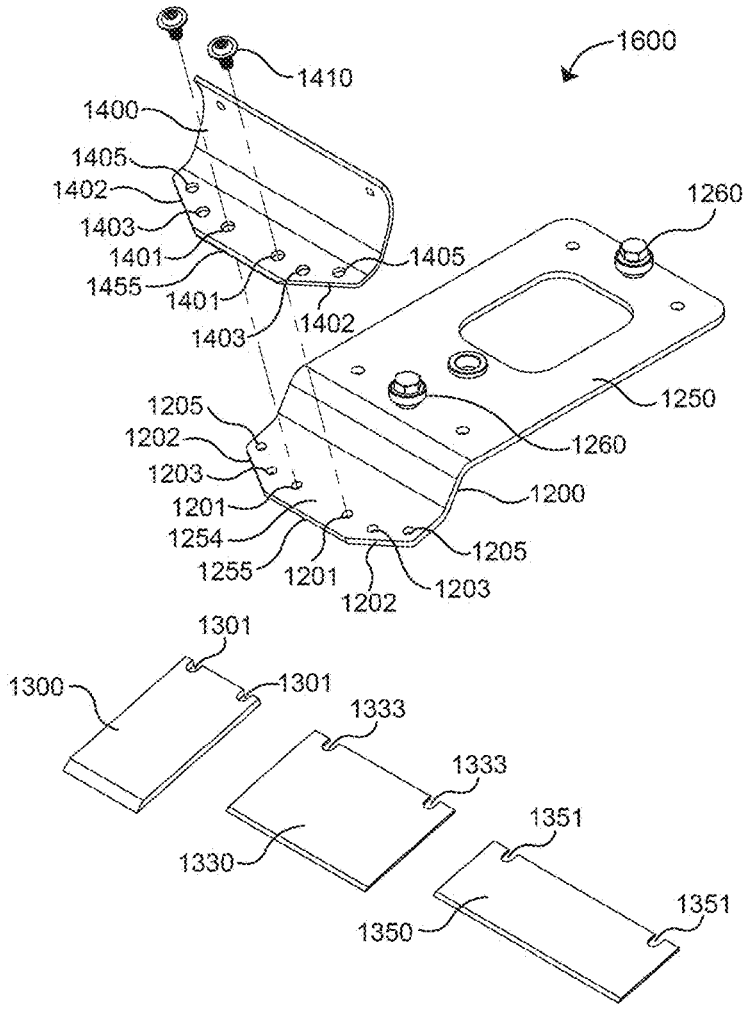
FIG. 5 is a partially exploded view of a blade carrier assembly and blades for a motorized floor stripper machine, in accordance with an embodiment of the invention.

Fastened to blade carrier 1200 at blade carrier top surface 1250 are two ball bearings 1260. Ball bearings 1260 are fastened to blade carrier top surface 1250 by nuts 1270 and bolts 1280. Ball bearings 1260 are positioned at a height above blade carrier top surface 1250 by spacers 1290 mounted on bolts 1280. FIG. 5 shows the finished assembly of ball bearings 1260 onto blade carrier top surface 1250.

As shown in FIG. 4, ball bearings 1260 attached to blade carrier 1200 are insertable into channels 1040 mounted on frame bottom surface 1110. Channels 1040 operate as a blade carrier guide to guide the motion of ball bearings 1260 (which act as blade carrier guide inserts) and blade carrier 1200 so that the orbital motion imparted by pivot pin 1230 is converted to a generally forward and backward motion, and generally without undesirable left to right motion. In this way, the blade carrier 1200 is linearly coupled to the channels 1040. As a result, as shown in FIG. 3, stripper machine 1000 produces a cutting motion in a blade such as blade 1300 that is generally forward only (as indicated by arrow A), and generally not transverse. Furthermore, as shown in FIG. 4, due to the guidance provided by channels 1040 and ball bearings 1260, embodiments of the stripper machine 1000 avoid or reduce the recoiling of the blade carrier 1200 on shock absorbers 1120 when stripping a tough or hard material, such as wood or ceramic tile.

Embodiments of the stripper machine 1000 produces motion that is forward and backward only (or substantially only forward and backward), and additionally includes shock absorbers 1120 to absorb the impact of blade carrier 1200 against the floor if the front of the machine is dropped. If the front of the machine is dropped, causing blade carrier 1200 to impact a floor surface, shock absorbers 1120 absorb the impact to reduce or prevent damage to blade carrier 1200 and connected parts.

As shown in FIG. 5, blade carrier 1200 provides a number of mounting locations for blades of various widths. Blade 1300 is narrower than conventional blades and is mountable at blade carrier inner holes 1201. To mount blade 1300 to the blade carrier 1200, blade 1300 is placed on top of blade carrier 1200 at blade carrier front top surface 1254, with the blade slots 1301 aligned with blade carrier inner holes 1201 (which provide an interface for releasably mounting the blade 1300). Blade carrier 1200 has a front edge 1255. A blade clamp 1400 having a blade clamp front edge 1455 is placed on top of blade 1300 with blade clamp inner holes 1401 also aligned with blade slots 1301. Blade clamp screws 1410 are passed through blade clamp inner holes 1401 and blade slots 1301, and threaded and tightened into blade carrier inner holes 1201.

Blade carrier 1200 and blade clamp 1400 have relieved edges 1202 and 1402 respectively, both relieved at the same angle. These relieved edges allow the blade carrier 1200 and blade clamp 1400 to enter a row where material has already been stripped by a narrow blade, such as blade 1300, without having these edges contact the edges of unstripped materials to either side.

As used herein, a blade carrier assembly includes a blade carrier having a top surface for mounting a blade, a blade clamp, and fasteners fastening the blade clamp to the blade carrier. As one example, as shown in FIG. 5, blade carrier assembly 1600 includes a blade carrier 1200 with a blade carrier front top surface 1254 for mounting a blade, a blade clamp 1400, with blade clamp screws 1410 being the fasteners.

Figure 6:
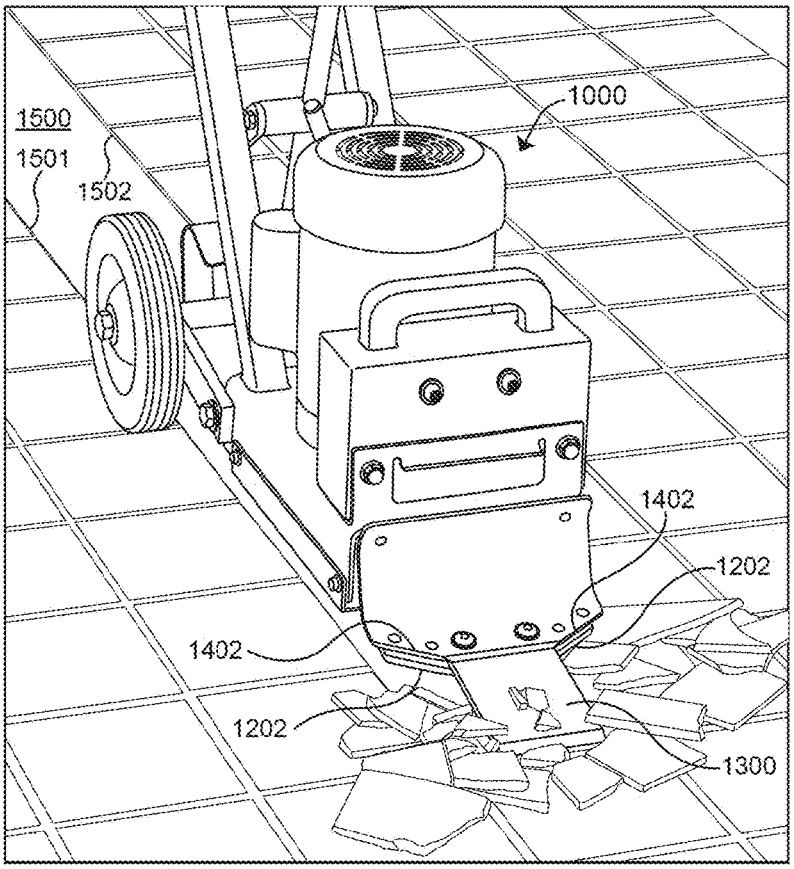
FIG. 6 shows a stripper machine stripping a ceramic tile floor, in accordance with an embodiment of the invention.

FIG. 6 shows stripper machine 1000 stripping a ceramic tile floor, which is a hard material that tends to strip from the floor in a narrow row 1500. Edges 1501, 1502 are the edges of unstripped areas of the ceramic tile floor to the left and right of row 1500. Blade carrier relieved edges 1202 and blade clamp relieved edges 1402 enter at row 1500 without impacting edges 1501, 1502, which would create unnecessary resistance and would hold blade 1300 at a height that would prevent it from effectively getting beneath the ceramic tile to effectively strip it from the subfloor.

As shown in FIG. 5, if a medium width blade such as blade 1330 is to be mounted on blade carrier 1200, it can be mounted using blade carrier middle holes 1203 (which provide an interface for releasably mounting the blade 1330), blade slots 1333, and blade clamp middle holes 1403. The portion of blade carrier relieved edges 1202 and blade clamp relieved edges 1402 to the left or right of blade 1330 will also enter a row where material has already been stripped by blade 1330 without these edges impacting the edges of unstripped materials to either side.

Wider blades such as blade 1350 can be mounted at blade carrier outer holes 1205 (which provide an interface for releasably mounting the blade 1350), blade slots 1351, and blade clamp outer holes 1405. Blades as wide as blade 1350 or wider can be mounted with these outer holes.

As shown in FIG. 3, Stripper machine 1000 addresses many problems of conventional stripper machines. As shown in FIG. 4, channels 1040 provide guidance for blade carrier 1200 such that its motion is limited to forward and backward motion only. Channels 1040 prevent blade carrier 1200 from recoiling against shock absorbers 1120 if a tough or hard material is encountered by blade 1300. Channels 1040 are compact in comparison to those formed in the heavy cutting arm housings of some conventional stripper machines. Yet channels 1040 provide the same benefits, and are mountable to bottom surface 1110 of frame 1100, which can be formed as a conventional sheet metal part. Ball bearings 1260 are durable and well-suited for insertion into a channel shape for guiding the motion of blade carrier 1200. These features enable stripper machine 1000 to be economically manufactured and maintained because channels 1040 can be mass-produced to great precision from raw steel stock, and ball bearings 1260 are highly durable off-the-shelf components.

Blade carrier 1200 is mounted on shock absorbers 1120, which absorb impact if the front of the stripper machine is dropped on its front end, causing blade carrier 1200 to impact a floor surface. As shown in FIG. 5, blade carrier 1200 and blade clamp 1400 provide holes for mounting blades of varying widths, while the relieved edges 1202, 1402 allow the blade carrier 1200 and blade clamp 1400 to enter a row where flooring material has already been stripped, without contacting the edges of unstripped materials to either side. Blade change is simple with a blade being mounted on top of blade carrier 1200, with the blade clamp 1400 fastened down on top of a blade using conventional fasteners.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A motorized floor stripper machine comprising:

a frame having a bottom surface;

a motor attached to the frame;

a cam coupled to the motor to produce an orbital motion that defines a plane;

one or more blade carrier guides enclosing a vertical opening mounted to the bottom surface of the frame;

a blade carrier having one or more blade carrier guide inserts insertable within the one or more blade carrier guides to constrain the blade carrier to move in a linear motion in a cutting direction, where the one or more blade carrier guide inserts are moveable in a vertical direction within the vertical opening of the one or more blade carrier guides, where the vertical direction is orthogonal to the plane of the orbital motion; and a linkage coupling the cam to the blade carrier to impart a motion from the cam to the blade carrier, wherein the one or more blade carrier guides are one or more channels, and wherein the one or more blade carrier guide inserts of the blade carrier comprise one or more rotatable ball bearings fastened to the blade carrier, the one or more rotatable ball bearings insertable within one of the one or more channels.

2. The motorized floor stripper machine of claim 1, wherein the linkage comprises:

a pivot plate connected to the cam; and a pivot pin connecting the pivot plate to the blade carrier.

3. The motorized floor stripper machine of claim 1, further comprising:

one or more shock absorbers coupling the blade carrier to the bottom surface of the frame.

4. A motorized floor stripper machine comprising:

a frame having a bottom surface;

a motor attached to the frame;

a cam coupled to the motor to produce an orbital motion that defines a plane;

one or more blade carrier guides enclosing a vertical opening mounted to the bottom surface of the frame;

a blade carrier having one or more blade carrier guide inserts insertable within the one or more blade carrier guides to constrain the blade carrier to move in a linear motion in a cutting direction, where the one or more blade carrier guide inserts are moveable in a vertical direction within the vertical opening of the one or more blade carrier guides, where the vertical direction is orthogonal to the plane of the orbital motion; and a linkage coupling the cam to the blade carrier to impart a motion from the cam to the blade carrier, wherein the blade carrier has a top surface that includes an interface for releasably mounting a blade, where the interface for releasably mounting a blade comprises a plurality of pairs of blade fastener holes set apart by different widths to accommodate a plurality of differently sized blades, and where a first pair of the plurality of blade fastener holes for mounting a blade of a first width are positioned between a second pair of the plurality of blade fastener holes for mounting a blade of a second wider width, and where a portion of the blade carrier outside the first pair of blade fastener holes and inside the second pair of blade fastener holes is relieved from an area inside the first pair of blade fastener holes.

5. A motorized floor stripper machine comprising:

a frame having a bottom surface;

a motor attached to the frame;

a cam coupled to the motor to produce an orbital motion that defines a plane;

one or more blade carrier guides mounted to the bottom surface of the frame; and a blade carrier coupled to the cam and linearly coupled to the one or more blade carrier guides, where the blade carrier is moveable in a direction orthogonal to the plane of the orbital motion;

wherein when the motor drives the cam to produce an orbital motion, the cam imparts a linear motion to the blade carrier, and wherein the one or more blade carrier guides are one or more channels, and wherein the blade carrier is linearly coupled to the one or more channels by one or more rotatable ball bearings fastened to the blade carrier and insertable within the one or more channels.

6. The motorized floor stripper machine of claim 5, wherein the blade carrier is coupled to the cam by a pivot plate connected to the cam and a pivot pin connecting the pivot plate to the blade carrier.

7. The motorized floor stripper machine of claim 5, further comprising:

one or more shock absorbers coupling the blade carrier to the bottom surface of the frame.

8. A motorized floor stripper machine comprising:

a frame having a bottom surface;

a motor attached to the frame;

a cam coupled to the motor to produce an orbital motion that defines a plane;

one or more blade carrier guides mounted to the bottom surface of the frame; and a blade carrier coupled to the cam and linearly coupled to the one or more blade carrier guides, where the blade carrier is moveable in a direction orthogonal to the plane of the orbital motion;

wherein when the motor drives the cam to produce an orbital motion, the cam imparts a linear motion to the blade carrier, and wherein the blade carrier has a top surface that includes an interface for releasably mounting a blade, where the interface for releasably mounting a blade comprises a plurality of pairs of blade fastener holes set apart by different widths to accommodate a plurality of differently sized blades, and where a first pair of the plurality of blade fastener holes for mounting a blade of a first width are positioned between a second pair of the plurality of blade fastener holes for mounting a blade of a second wider width, and where a portion of the blade carrier outside the first pair of blade fastener holes and inside the second pair of blade fastener holes is relieved from an area inside the first pair of blade fastener holes.

9. A blade carrier assembly for a motorized floor stripper machine, the blade carrier assembly comprising:

a blade carrier having a front top surface for mounting a blade, the blade carrier including a plurality of blade fastener holes; and a blade clamp fastenable to the blade carrier front top surface, the blade clamp including a plurality of blade fastener holes;

wherein a first pair of the plurality of blade fastener holes for mounting a blade of a first width are positioned between a second pair of the plurality of blade fastener holes for mounting a blade of a second width that is wider than the first width; and where a portion of the blade carrier outside the first pair of blade fastener holes and inside the second pair of blade fastener holes is relieved from an area inside the first pair of blade fastener holes.

* * * * *